US010738517B2

(12) United States Patent
Mislak

(10) Patent No.: US 10,738,517 B2
(45) Date of Patent: Aug. 11, 2020

(54) ELECTROMAGNETIC ACCESS PANEL LATCHES

(71) Applicant: Johnson Controls Technology Company, Plymouth, MI (US)

(72) Inventor: Nicholas P. Mislak, Bel Air, MD (US)

(73) Assignee: Johnson Controls Technology Company, Auburn Hills, MI (US)

( * ) Notice: Subject to any disclaimer, the term of this patent is extended or adjusted under 35 U.S.C. 154(b) by 437 days.

(21) Appl. No.: 15/608,742

(22) Filed: May 30, 2017

(65) Prior Publication Data

US 2018/0155969 A1 Jun. 7, 2018

Related U.S. Application Data

(60) Provisional application No. 62/431,186, filed on Dec. 7, 2016.

(51) Int. Cl.

| | |
|---|---|
| ***E05C 19/16*** | (2006.01) |
| ***E05B 65/00*** | (2006.01) |
| *F24F 11/30* | (2018.01) |

(52) U.S. Cl.

CPC ..... *E05C 19/166* (2013.01); *E05B 65/006* (2013.01); *F24F 11/30* (2018.01)

(58) Field of Classification Search

CPC ..... E05C 19/166; E05C 19/168; E05C 19/16; E05B 65/006; E05B 9/00; F24F 11/30; F24F 1/14; F24F 11/00; F16J 13/00

USPC ..... 292/251.5

See application file for complete search history.

(56) References Cited

U.S. PATENT DOCUMENTS

| | | | | |
|---|---|---|---|---|
| 5,479,151 | A * | 12/1995 | Lavelle | E05B 65/108 292/251.5 |
| 6,857,671 | B2 * | 2/2005 | Fly | E05B 17/2084 292/251.5 |
| 7,603,882 | B2 * | 10/2009 | Carbajal | A47F 3/043 70/267 |
| 8,570,169 | B2 * | 10/2013 | Green | G06Q 10/08 340/5.2 |
| 8,701,431 | B2 * | 4/2014 | Jeung | F24F 1/06 62/259.1 |
| 2004/0222645 | A1 * | 11/2004 | Pirone | E05C 19/166 292/251.5 |
| 2011/0155343 | A1 * | 6/2011 | Boudreau | F24F 12/00 165/10 |
| 2016/0047144 | A1 * | 2/2016 | McMillan | E05C 19/166 70/263 |
| 2016/0084267 | A1 * | 3/2016 | Showole | F24F 1/04 55/495 |

(Continued)

FOREIGN PATENT DOCUMENTS

| | | |
|---|---|---|
| GB | 2420279 | 5/2006 |
| WO | 2007077095 | 7/2007 |

*Primary Examiner* — Nathan Cumar

(74) *Attorney, Agent, or Firm* — Fletcher Yoder, P.C.

(57) ABSTRACT

A heating, ventilating, and air conditioning (HVAC) system includes an HVAC unit. The HVAC unit includes an enclosure having a panel disposed in a corresponding opening of the enclosure. The HVAC unit also includes a heat exchanger disposed within an interior of enclosure. Moreover, the HVAC unit includes an electromagnetic lock fixed to a surface of the interior of the enclosure. The electromagnetic lock is configured to retain the panel in a closed position relative to the enclosure.

25 Claims, 7 Drawing Sheets

(56) References Cited

U.S. PATENT DOCUMENTS

2016/0113415 A1* 4/2016 Albregts ..... G07F 9/105
62/246
2016/0286998 A1* 10/2016 Lindbo ..... A47G 29/141

* cited by examiner

ELECTROMAGNETIC ACCESS PANEL LATCHES

CROSS REFERENCE TO RELATED APPLICATIONS

This application claims priority from and the benefit of U.S. Provisional Patent Application No. 62/431,186, entitled "ELECTROMAGNETIC ACCESS PANEL LATCHES," filed Dec. 7, 2016, which is hereby incorporated by reference.

BACKGROUND

The present disclosure relates generally to heating, ventilating, and air conditioning systems (HVAC) and, more particularly, to electromagnetic access panel latches of the HVAC systems.

A wide range of applications exists for HVAC systems. For example, residential, light commercial, commercial, and industrial systems are used to control temperatures and air quality in indoor environments and buildings. Generally, HVAC systems may circulate a fluid, such as a refrigerant, through a closed loop between an evaporator where the fluid absorbs heat and a condenser where the fluid releases heat. The fluid flowing within the closed loop is generally formulated to undergo phase changes within the normal operating temperatures and pressures of the system so that quantities of heat can be exchanged by virtue of the latent heat of vaporization of the fluid.

HVAC units, such as heat exchangers, air handlers, heat pumps, and air conditioning units used to provide conditioned air to conditioned environments, may be disposed within enclosures. In certain applications, the enclosures of the HVAC units are manually locked to restrict access to the HVAC units. Depending on the type of manual lock, the lock may wear with age, protrude from an exterior of the enclosure, and/or be unscrewed from the enclosure. Accordingly, it may be desirable to improve the security and durability of locks of enclosures of the HVAC units.

SUMMARY

In one embodiment of the present disclosure, a heating, ventilating, and air conditioning (HVAC) system includes an HVAC unit. The HVAC unit includes an enclosure having a panel disposed in a corresponding opening of the enclosure. The HVAC unit also includes a heat exchanger disposed within an interior of the enclosure. Additionally, the HVAC unit includes an electromagnetic lock fixed to a surface of the interior of the enclosure. The electromagnetic lock is configured to retain the panel in a closed position relative to the enclosure.

In another embodiment of the present disclosure, a control system of a heating, ventilating, and air conditioning (HVAC) system includes an electromagnetic lock fixed to a surface of an HVAC unit having a panel. The electromagnetic lock is configured to selectively retain the panel in a closed position. Additionally, the HVAC system includes a power source coupled to the electromagnetic lock and configured to provide power to the electromagnet lock. The HVAC system also includes a controller configured to selectively engage and disengage the electromagnetic lock. Moreover, the controller is configured to transmit a first signal to the power source to engage the electromagnetic lock. The electromagnetic lock retains the panel in the closed position when the electromagnetic lock is engaged.

Further, the controller is configured to transmit a second signal to the power source to disengage the electromagnetic lock. The electromagnetic lock does not retain the panel in the in the closed position when the electromagnetic lock is disengaged.

In a further embodiment of the present disclosure, a heating, ventilating, and air conditioning (HVAC) system includes an HVAC unit. The HVAC unit includes an enclosure having a panel. Additionally, the HVAC unit includes a heat exchanger disposed within an interior of enclosure. The heat exchanger is accessible when the panel is in an open position relative to the enclosure and the heat exchanger is not accessible when the panel is in a closed position relative to the enclosure. The HVAC unit also includes an electromagnetic lock disposed in the enclosure and an opposed element of the panel. The opposed element is adjacent to the electromagnetic lock when the panel is in the closed position. Additionally, the electromagnetic lock is configured to selectively produce a magnetic field that attracts the opposed element to retain the panel in the closed position.

Other features and advantages of the present application will be apparent from the following, more detailed description of the embodiments, taken in conjunction with the accompanying drawings, which illustrate, by way of example, the principles of the application.

DRAWINGS

Figure 5:
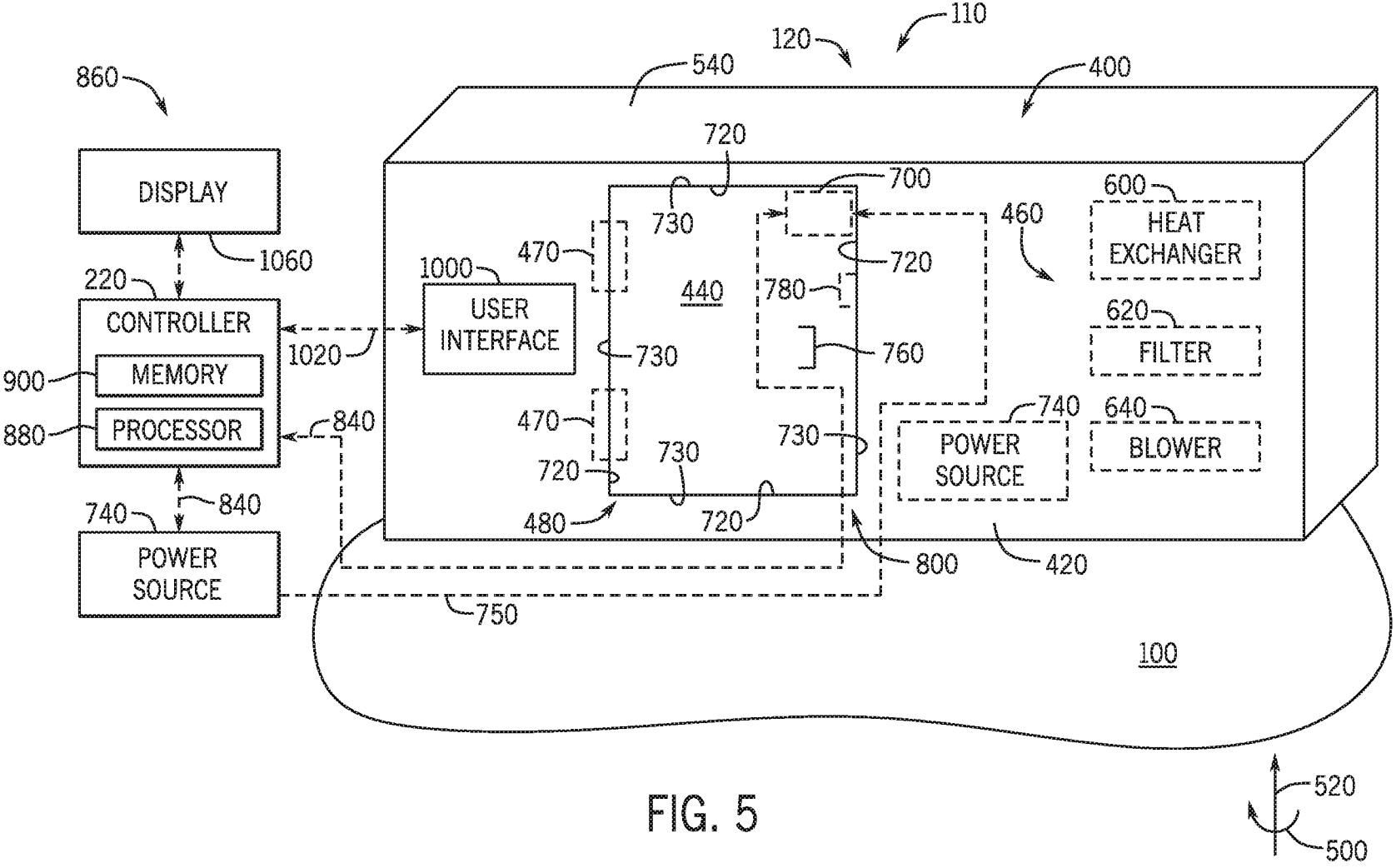
FIG. 5 is a perspective view of an enclosure of the HVAC system shown in FIG. 1, in accordance with an embodiment of the present techniques.
Figure 7:
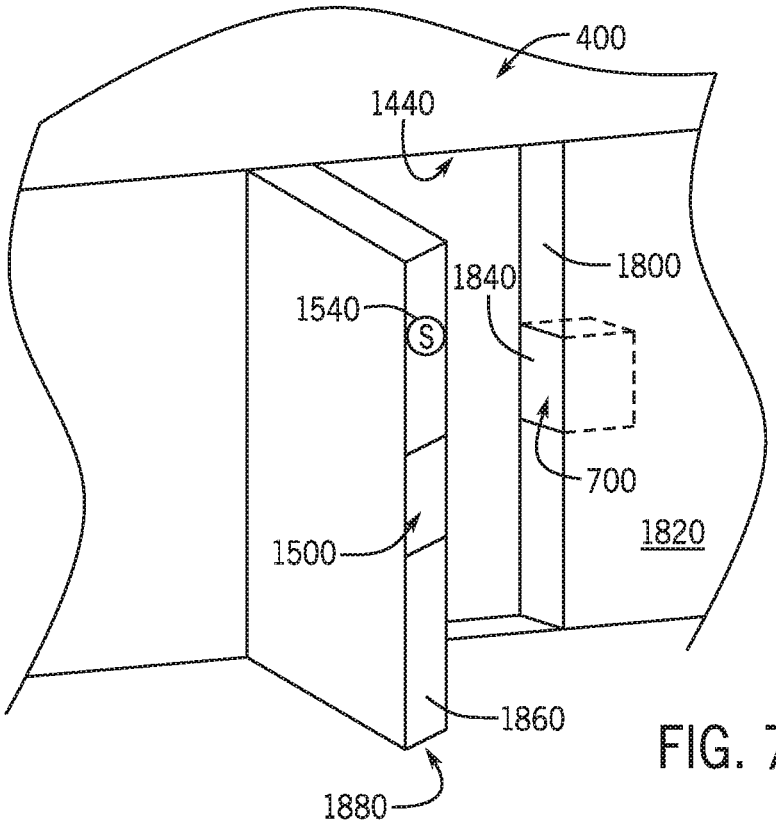
Figure 8:
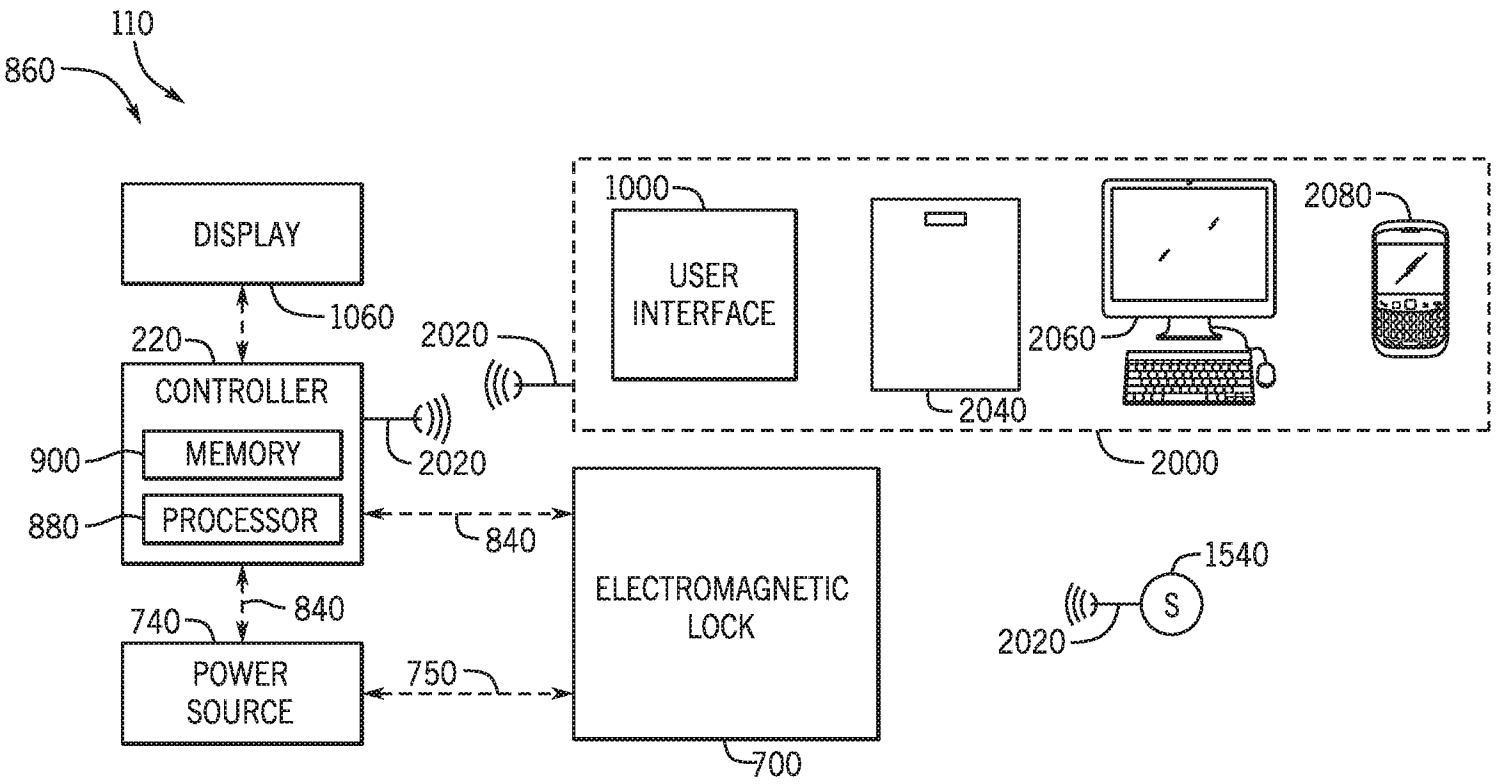

FIG. 7 is a partial perspective view of the enclosure shown in FIG. 5, in which the panel of the enclosure is in the open position, in accordance with an embodiment of the present techniques; and FIG. 8 is a schematic diagram of a controller of the HVAC system shown in FIG. 5, illustrating communication of the controller with various devices, in accordance with an embodiment of the present techniques.

DETAILED DESCRIPTION

The present disclosure is directed to heating, ventilating, and air conditioning (HVAC) systems and electromagnetic access panel latches of HVAC systems that control access to a rooftop unit, an HVAC unit, or another enclosure of the HVAC systems. In general, HVAC systems may include a rooftop unit disposed on top of a building. The rooftop unit may include heat exchangers, blowers, filters, and/or other HVAC components to provide conditioned air to the building. To protect the HVAC components, the rooftop unit includes an enclosure disposed around the HVAC components. The enclosure may be a rigid structure that protects the HVAC components from contaminants and debris on the building. Additionally, a panel (e.g., access panel) providing access to an interior of the enclosure may be locked to protect the HVAC components from unauthorized users. While the discussion below is focused on rooftop units of HVAC systems, it should be appreciated that the disclosed embodiments may be utilized with other enclosures of HVAC systems.

In some embodiments, the panel is locked by an electromagnetic lock (e.g., electromagnetic access panel latch). The electromagnetic lock may provide a greater resistance to wear, degradation, tampering, and/or malfunctioning than traditional keyed locks. That is, the electromagnetic lock may improve security and decrease wear associated with locking the panel. For example, the electromagnetic lock may generate a magnetic field that retains the panel in a closed position by magnetically attracting an opposed element of the panel. The magnetic field may be selectively generated when power from a power source is supplied to coils of the electromagnetic lock. The electromagnetic lock may additionally be communicatively coupled to a controller that determines if user input from a user is indicative that the user is authorized (e.g., authorized to unlock the panel and access an interior of the enclosure). If the controller determines that the user is authorized, the controller may instruct the power source to interrupt the supply of power to the electromagnetic lock, such that the electromagnetic lock disengages. Accordingly, authorized users may open the panel to access the HVAC components. The controller may automatically engage the electromagnetic lock again after a time threshold has passed, after the panel has been closed, and/or when operating hours of the building are concluded. Additionally, the controller may collect information related to the electromagnetic lock, such as a log of when the electromagnetic lock was disengaged, when the panel was open, how long the electromagnetic lock was disengaged, how long the panel was open, and/or which credentials were provided to the user interface. Thus, by including an electromagnetic lock on the enclosure, a panel of the enclosure may only be opened to provide authorized users access to the HVAC components, while providing valuable information related to the access of the enclosure.

Figure 1:
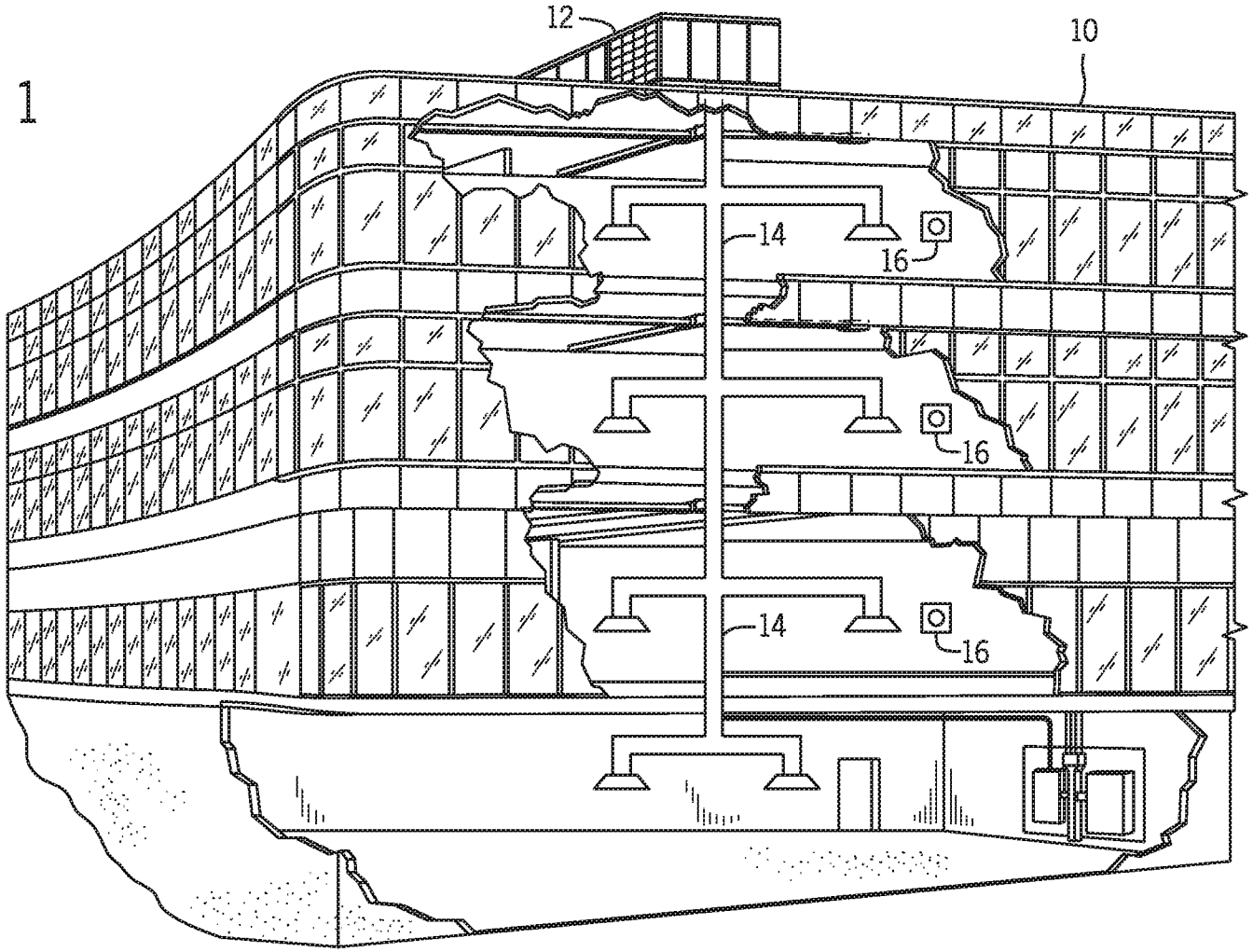
FIG. 1 is a perspective view of a commercial or industrial HVAC system, in accordance with an embodiment of the present techniques.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
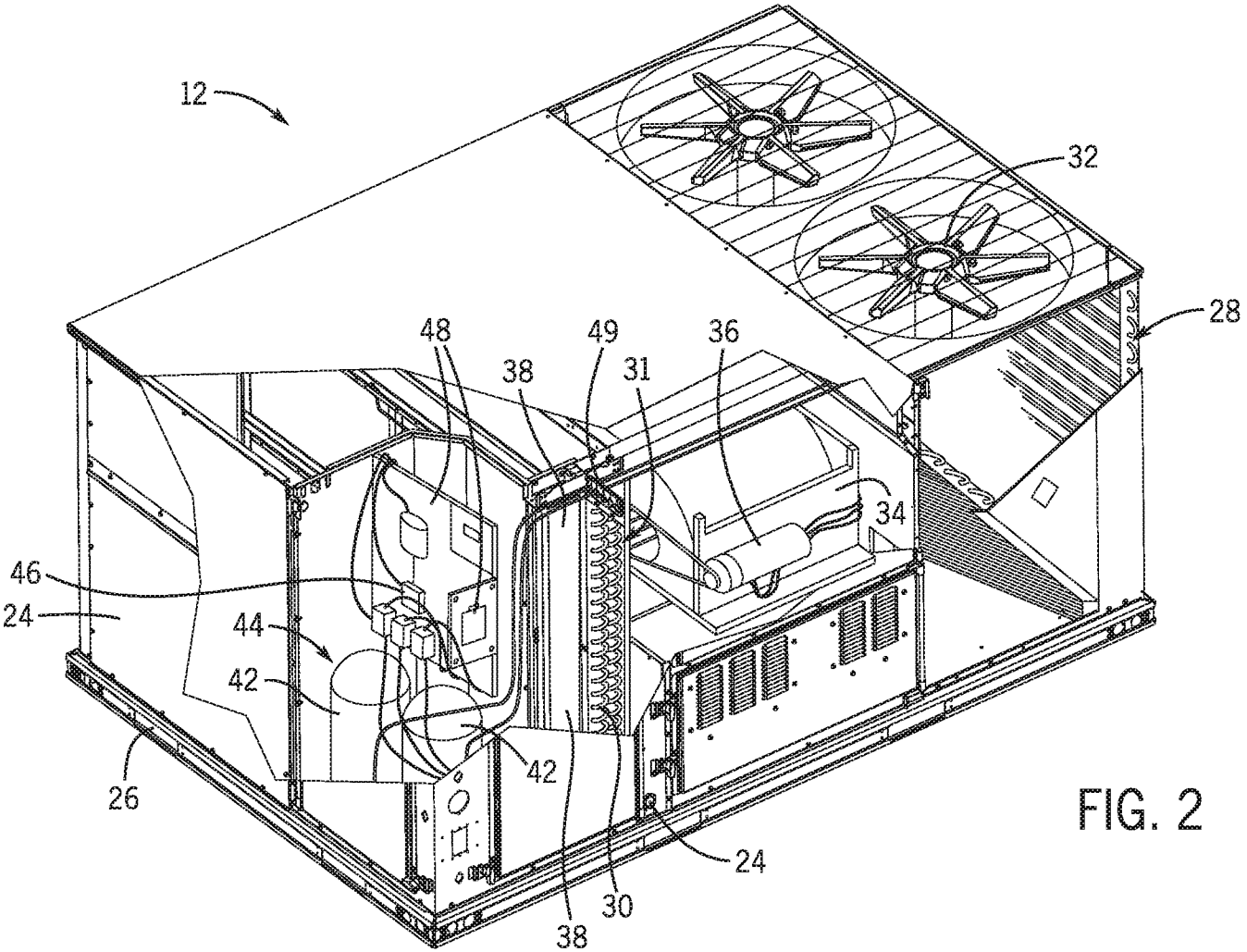
FIG. 2 is an illustration of an embodiment of a packaged unit of the HVAC system shown in FIG. 1, in accordance with an embodiment of the present techniques.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
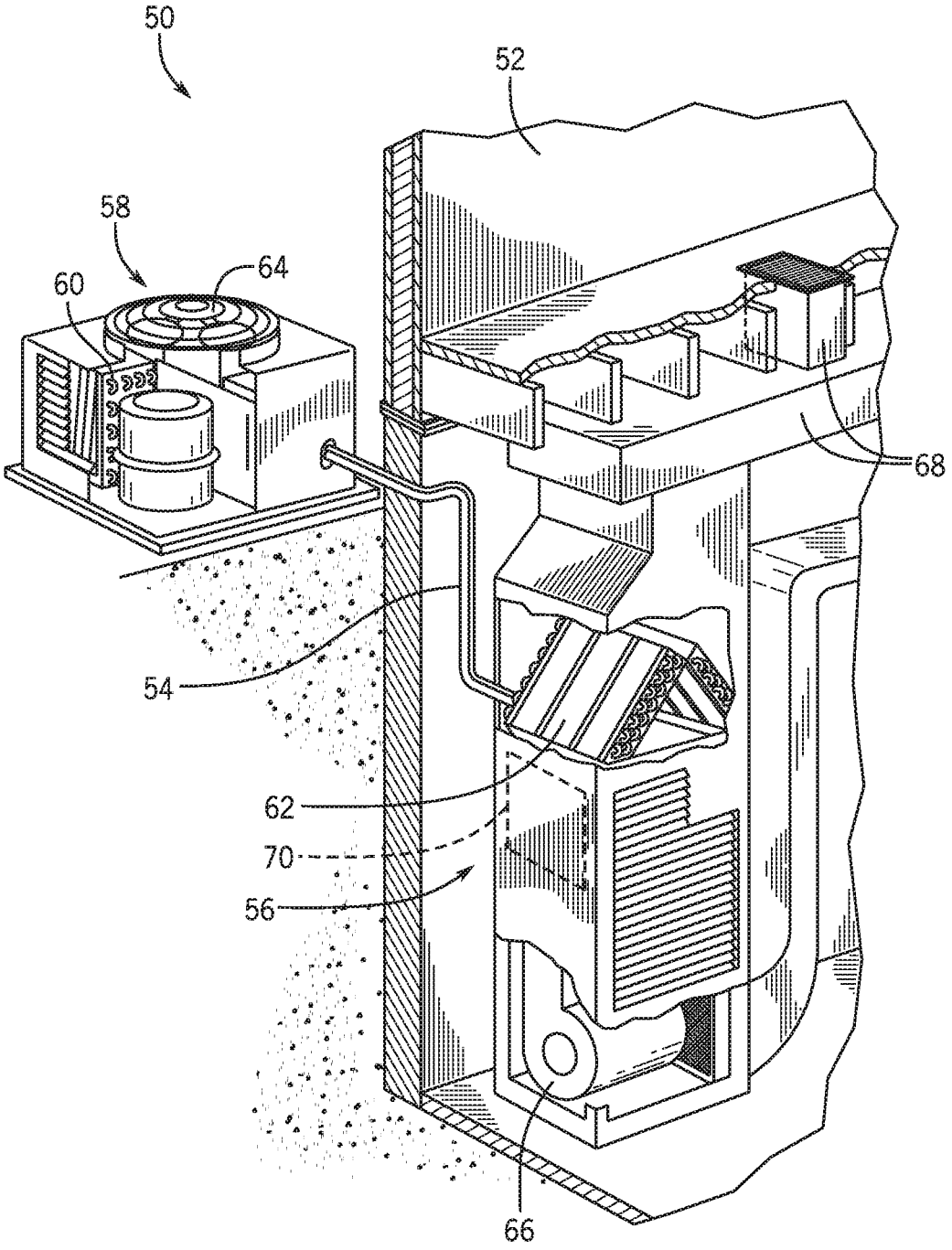
FIG. 3 is an illustration of an embodiment of a split system of the HVAC system shown in FIG. 1, in accordance with an embodiment of the present techniques.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
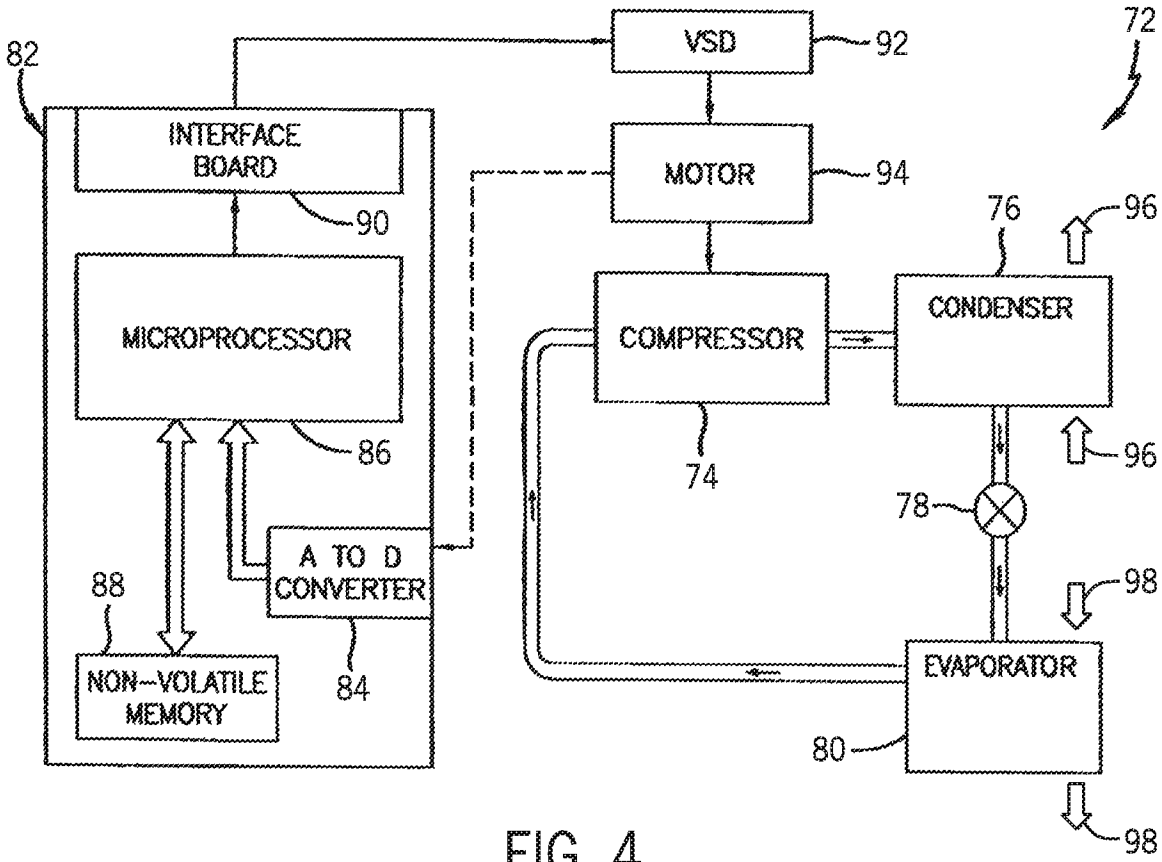
FIG. 4 is a schematic diagram of an embodiment of a refrigeration system of the HVAC system shown in FIG. 1, in accordance with an embodiment of the present techniques.

FIG. 4 is an embodiment of a vapor compression system 72 that can be used in any of the systems described above.

The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, the present techniques are directed to electromagnetic access panel latches of HVAC systems. For example, the control device 16 discussed above may be part of a control system that verifies user input from users to determine if the users are authorized users. If the users are determined to be authorized users, the control device 16 or other part of the control system may selectively disengage an electromagnetic lock of the HVAC unit 12 to enable opening of an access panel of the HVAC unit 12. Moreover, the control device 16 may communicate with computer systems that are integrated with or separate from other building control or monitoring systems, including systems that are remote from the building 10. For example, the control device 16 may communicate with a user interface that users employ to provide the user input. Based on the user input from the user interface, the control device 16 may selectively engage or disengage the electromagnetic lock of the rooftop unit 12. Further, the control device 16 may selectively engage or disengage the electromagnetic lock by controlling a supply of power to the electromagnetic lock, as discussed in more detail below. The electromagnetic lock may provide a greater resistance to wear, degradation, tampering, and/or malfunctioning than traditional keyed locks. That is, the electromagnetic lock may improve security and decrease wear associated with locking the HVAC unit 12 by generating a magnetic field that retains a panel of the HVAC unit 12 in a closed position.

FIG. 5 is a schematic perspective view of a rooftop unit 120 having a panel for accessing HVAC components within In some embodiments, the rooftop unit 120 is one of many HVAC units of the building 10 discussed above that may include an electromagnetic lock in accordance with the present techniques. The rooftop unit 120 may be part of an HVAC system 110 of a building 100. For example, the rooftop unit 120 is disposed on top of the building 100, but it is to be understood that in other embodiments, the rooftop unit 120 may be located in another location, or the electromagnetic locks may be provided on other structures or enclosures of the HVAC system 110. As shown, the rooftop unit 120 includes an enclosure 400. The enclosure 400 is a rectangular prism having a front surface 420. However, it is to be understood that in other embodiments, the enclosure 400 may have another suitable shape, such as a cylinder.

The enclosure 400 has a panel 440 disposed in the front surface 420. The panel 440 provides access to HVAC components 460 of the HVAC system 110 disposed within the enclosure 420. In some embodiments, the panel 440 is a rectangular element (e.g., a door) disposed within a similarly shaped opening in the front surface 420. The panel 440 may additionally include hinges 470 disposed on a first side 480 of the panel 440. As such, the panel 440 may be opened along a circumferential direction 500 around a vertical axis 520 of the rooftop unit 120. In some embodiments, the panel 440 may be disposed in a different surface of the panel 440, such as a top surface 540. Moreover, the hinges 470 may be disposed at another location on the panel 440 and/or the front surface 420, such that the panel 440 may be opened in a different manner.

In some embodiments, the HVAC components 460 include a heat exchanger 600, a filter 620, and/or a blower 640. The HVAC components 460 may further include any suitable components of the HVAC system 110 that would be desirably locked within the enclosure 400. The HVAC components 460 are disposed within an interior of the enclosure 400 such that the panel 440 may provide access to the HVAC components 460. That is, after opening the panel 440, a user may access the HVAC components 460 by reaching within the opening and/or entering the enclosure 400. In some embodiments, the panel 440 may cover HVAC components 460 that are disposed directly underneath the panel 440. The user may access the HVAC components 460 to perform installations within the enclosure 400, repair or perform maintenance on one or more HVAC components 460, replace one or more HVAC components 460, and/or inspect one or more HVAC components 460.

It may be desirable to reduce ingress of contaminants and to restrict access of unauthorized users to the HVAC components 460. To this end, the enclosure 400 includes an electromagnetic lock 700. As will be appreciated, the electromagnetic lock 700 may provide a greater resistance to wear, degradation, tampering, and/or malfunctioning than traditional keyed locks. In this manner, the electromagnetic lock 700 may improve security and decrease wear associated with locking the panel 440. The electromagnetic lock 700 may be mounted in an interior of the enclosure 400, on a surface of the enclosure 400, in a surface of the enclosure 400, on a surface of the panel 440, and/or in a surface of the panel 440. In some embodiments, an upper surface of the electromagnetic lock 700 is mounted on the enclosure 400, and a front surface of the electromagnetic lock 700 is in contact with the panel 440. In some embodiments, one or more additional electromagnetic locks 700 may be included with the enclosure 400. Moreover, certain enclosures 400 may be retrofitted with electromagnetic locks 700.

When engaged, the electromagnetic lock 700 retains the panel 440 in contact with the electromagnetic lock 700. As such, edges 720 of the front surface 420 of the enclosure 400 contact and/or are adjacent to corresponding edges 730 of the panel 440. The panel 440 may be considered to be in a closed position when one or more of the corresponding edges 730 of the panel 440 are in contact with and/or are adjacent to one or more of the edges 720 of the enclosure 400. The panel 440 may similarly be considered to be in an open position when one, two, or three of the corresponding edges 730 of the panel 440 are not in contact with and/or not adjacent to the edges 720 of the enclosure 400. Accordingly, the electromagnetic lock 700 may be any suitable type of electromagnetic lock 400 for selectively retaining the panel 440 in the closed position.

To operate the electromagnetic lock 700, a power source 740 may provide power 750 to the electromagnetic lock 700. As shown, the power source 740 may be disposed within the interior of the enclosure 400. For example, the power source 740 may be disposed in a space in the interior of the enclosure 400 that is shared by the HVAC components 460 or the power source 740 may be disposed in a separate space in the interior of the enclosure 400. The power source 740 may include one or more batteries, one or more capacitors, one or more generators, one or more connections to a power supply of the building, one or more connections to an energy grid, and/or another suitable power source for providing power 750 to the electromagnetic lock 700. The power 750 may travel from the power source 740, through a connection, then through one or more coils of wire (e.g., solenoids) within the electromagnetic lock 700. Current moving through the coils of wire generates a magnetic field. In some embodiments, the coils of wire may surround a ferromagnetic core to increase the strength of the magnetic field. The magnetic field produced by the electromagnetic lock 700 attracts ferromagnetic materials such as iron, steel, nickel, cobalt, gadolinium, and weakly attracts paramagnetic materials such as lithium, oxygen, calcium, titanium. When the power 750 is supplied to the electromagnetic lock 700, the electromagnetic lock 700 is engaged. Additionally, when the power 750 is not supplied to the electromagnetic lock, the electromagnetic lock 700 is disengaged.

In some embodiments in which the electromagnetic lock 700 is engaged, the magnetic field produced by the electromagnetic lock 700 attracts an opposed element disposed opposite of the electromagnetic lock 700. For example, when the electromagnetic lock 700 is mounted within the enclosure 400, the opposed element may be the panel 440, a portion of the panel 440, or a plate affixed (e.g., welded, laminated, fastened) to the panel 440. The magnetic field of the electromagnetic lock 700 then retains the opposed element in contact with the electromagnetic lock 700. The electromagnetic lock 700 may produce a holding force upward of 500 pounds, 1000 pounds, 1500 pounds, or more. That is, the electromagnetic lock 700 may be resistant to applications of force less than the holding force. In some embodiments, the magnetic field produced by the electromagnetic lock 700 may retain the panel 440 in the closed position. In some embodiments, the magnetic field of the electromagnetic lock 700 is strong enough to pull the panel 440 from the open position or an ajar position to the closed position and retain the panel 440 in the closed position. Additionally, in embodiments having additional electromagnetic locks 700, one or more additional opposed elements may also be included with the enclosure 400.

When the power source 740 does not supply the power 750 to the electromagnetic lock 700, the electromagnetic lock 700 is disengaged. The disengaged electromagnetic lock 700 does not produce the magnetic field, and thus does not attract the opposed element to retain the panel 440 in the closed position. As such, the panel 440 may be opened by a handle 760, a recess 780 disposed in a side 800 of the panel 440, or another suitable device for opening the panel 440. In some embodiments, the electromagnetic lock 700 may be a fail-secure (e.g., fail-closed) lock. That is, when a supply of power to the building 100 is interrupted, the electromagnetic lock 700 may still receive power from the power source 740 to remain engaged.

In some embodiments, a controller 220 of the HVAC system 110 is an electronic controller having electrical circuitry that processes data from certain components of the HVAC system 110 and/or provides one or more control signals 840 to certain components of the HVAC system 110. In some embodiments, the controller 220 is the control device 16 discussed above, or a different controller of the building 10. One or more of the certain components that control the HVAC system 110, including the electromagnetic lock 700 and the controller 220, may be considered to be part of a control system 860. While the controller 220 may be the control device 16 from FIG. 1, it is to be understood that the controller 220 may be a separate controller for controlling the electromagnetic lock 700 and/or monitoring security of the building 100. In the illustrated embodiment, the controller 220 includes a processor 880 and a memory device 900. The controller 220 may also include one or more storage devices and/or other suitable components. The processor 880 may be used to execute software, such as software for controlling the electromagnetic lock 700, and so forth. Moreover, the processor 880 may include multiple microprocessors, one or more "general-purpose" microprocessors, one or more special-purpose microprocessors, and/or one or more application specific integrated circuits (ASICS), or some combination thereof.

For example, the processor 880 may include one or more reduced instruction set (RISC) processors.

The memory device 900 may include a volatile memory, such as random access memory (RAM), and/or a nonvolatile memory, such as read-only memory (ROM). The memory device 900 may store a variety of information that may be used for various purposes. For example, the memory device 900 may store processor-executable instructions (e.g., firmware or software) for the processor 880 to execute, such as instructions for engaging and disengaging the electromagnetic lock 700. The storage device(s) (e.g., nonvolatile storage) may include ROM, flash memory, a hard drive, or any other suitable optical, magnetic, or solid-state storage medium, or a combination thereof. The storage device(s) may store data, instructions (e.g., software or firmware for controlling the HVAC system 110, etc.), and any other suitable data. The storage device(s) may also store scheduling data for engaging and disengaging the electromagnetic lock 700.

The controller 220 of the HVAC system 110 may provide the control signals 840 to the power source 740 and/or the electromagnetic lock 700 to control access to the HVAC components 460 within the enclosure 400. For example, the controller 220 may transmit the control signals 840 to the power source 740. The control signals 840 may include a first signal to instruct the power source 740 to supply the power 750 to the electromagnetic lock 700. The control signals 840 may additionally include a second signal to instruct the power source 740 to interrupt the supply of the power 750 to the electromagnetic lock 700. As such, the power source 740 selectively supplies the power 750 to the electromagnetic lock 700 based on the control signals 840 (e.g., first signals and second signals) from the controller 220. In some embodiments in which the power source 740 is included in a shared housing with the electromagnetic lock 700, the controller 220 may transmit the control signals 840 to the electromagnetic lock 700 directly to interrupt the supply of the power 750 to the electromagnetic lock 700.

The controller 220 may selectively engage or disengage the electromagnetic lock 700 based on input from a user interface 1000. The user interface 1000 may be disposed on the front surface 420 of the enclosure 400 to receive input provided from a user of the HVAC system 110. For example, the user may provide user input such as an access code to a number or key pad of the user interface 1000, provide an identification card to a card reader of the user interface 1000, provide additional user input to the user interface 1000, and/or provide additional user input to the controller 220, as discussed below with reference to FIG. 8. The user interface 1000 may analyze the user input to determine if the user is authorized to access the interior of the enclosure 400. For example, the user input may be compared to a database of authorized user inputs stored in a memory device 900 of the user interface 1000 to determine if the user input corresponds to an authorized user input. If the user interface 1000 recognizes the user input as authorized user input, the user interface then transmits a control signal 1020 to the controller 220 indicative of the authorized user input. Based on the control signal 1020, the controller 220 then instructs the power source 740 to interrupt the supply of the power 750 to the electromagnetic lock 700.

In some embodiments, the user interface 1000 may instead transmit the user input directly to the controller 220, which analyzes the user input. For example, the user input may be analyzed by comparing the user input to a database of authorized user inputs stored in the memory device 900. If the user input matches an entry in the database of authorized user input, the controller 220 determines that the user input corresponds to an authorized user input. As such, the controller 220 may then disengage the electromagnetic lock 700. The controller 220 may instruct the power source 750 to continue supplying the power 750 to the electromagnetic lock 700 if the controller 220 determines the user input does not correspond to authorized user input.

If authorized user input is provided, the power source 740 interrupts the supply of the power 750 to disengage the electromagnetic lock 700. In some embodiments, the electromagnetic lock 700 may be engaged again after a time threshold has passed. In some embodiments, the electromagnetic lock 700 may engage again after the electromagnetic lock 700 has been disengaged for 1 minute, 5 minutes, 1 hour, or another suitable time threshold (e.g., which may be stored within the memory device 90). Additionally, the electromagnetic lock 700 may engage again after the user has provided user input to the user interface 1000 to indicate that the user has completed the access to the interior of the enclosure 400. Moreover, the electromagnetic lock 700 may engage again after a sensor of the enclosure 400 determines that the panel 440 has been moved from the open position to the closed position. If the user is able to enter the enclosure 400 and the controller 220 is programmed to engage the electromagnetic lock 700 after the panel 440 has been moved from the open position to the closed position, the panel 440 may include an exit interface within the enclosure 400 to permit the user to exit the enclosure. In such embodiments, the exit interface instructs the controller 220 to disengage the electromagnetic lock 700 temporarily so that the user may exit the enclosure 400.

The controller 220 may collect and store data related to user access to the enclosure 400. For example, the controller 220 may collect and store user access data that includes time stamps of when the electromagnetic lock 700 is disengaged, durations of when the electromagnetic lock is disengaged, time stamps of when the panel 440 is opened, durations of when the panel 440 is open, a log of user inputs provided to the user interface 1000, a log of user inputs verified as authorized user inputs to the user interface 1000, a log of when the exit interface is employed, and/or other user access data related to the enclosure 400. The controller 220 may additionally collect operation data related to the operation of the HVAC system 110 or the rooftop unit 120.

A display 1060 may be communicative coupled to the controller 220 to display all or a portion of the user access data. The display 1060 may be located in a control room alongside the controller 220. For example, a user may operate the display 1060 to view all or a portion of the user access data of the enclosure 400 and/or the operation data of the HVAC system 110. The display 1060 may additionally provide an indication to the user when the electromagnetic lock 700 is disengaged and/or when the panel 440 is open. As such, the user of the display 1060 may monitor the access of the enclosure 400, including the HVAC components 460, to provide additional security to the HVAC components 460.

Further, the controller 220 may selectively engage or disengage the electromagnetic lock 700 based on the scheduling data stored in the memory device 900. The controller 220 may create or receive a corresponding locking schedule for the electromagnetic lock 700 that corresponds to the scheduling data. That is, the locking schedule may specify first scheduled times to engage the electromagnetic lock 700 and/or second scheduled times to disengage the electromagnetic lock 700. The controller 220 may then engage or disengage the electromagnetic lock 700 according to the first and second scheduled times. Additionally, it is to be understood that locking schedules may be individualized for each enclosure 400, such that the individualized locking schedules may be fit to any desired level of security. As such, the descriptions of scheduling data provided herein are intended as examples for how scheduling data may be used to create locking schedules.

For example, the scheduling data may include operating hours of the building 100 that describe times of the day, week, month, and year that the building 100 is in operation. The locking schedule for the electromagnetic lock 700 may be created to disengage the electromagnetic lock 700 when the building 100 is in operation and to disengage the electromagnetic lock 700 when the building is not in operation. That is, when the building 100 is in operation, the controller 220 may instruct the power source 740 to interrupt the power 750 supplied to the electromagnetic lock 700. Additionally, the controller 220 may instruct the power source 740 to supply the power 750 to the electromagnetic lock 700 when the building 100 is in operation. In some embodiments, the power source 740 will continue to provide or interrupt the supply of the power 750 until instructed otherwise by the controller 220. In some embodiments, the controller 220 may keep the electromagnetic lock 700 engaged when the building 100 is in operation, unless the controller 220 receives the user input that is indicative of authorized user input. In this manner, the locking schedule of the electromagnetic lock 700 may be specialized to deny access to the interior of the enclosure 400 when the building 100 is not in operation, to allow access to the interior of the enclosure 400 when the building 100 is in operation, and/or to selectively allow access to the interior of the enclosure when the building 100 is in operation and user input that is indicative of authorized user input is received.

Moreover, users may schedule access to the interior of the enclosure ahead of time by coordinating with a user of the controller 220. For example, if a user is scheduled to access the interior of the enclosure 400 at a certain time, the controller 220 may be programmed to selectively disengage the electromagnetic lock 700 for a duration of the scheduled access. That is, the controller 220 may edit the locking schedule for the electromagnetic lock 700 to provide the authorized user access to the interior of the enclosure 400 during the scheduled time. When the scheduled time is concluded, the controller 220 may then engage the electromagnetic lock 700 again.

Figure 6:
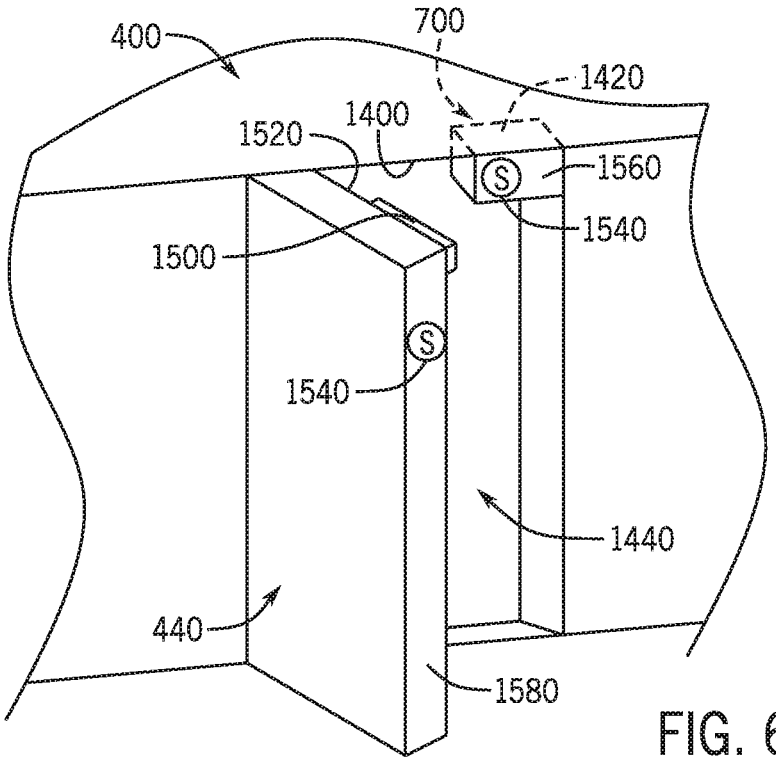
FIG. 6 is a partial perspective view of the enclosure shown in FIG. 5, in which a panel of the enclosure is in an open position, in accordance with an embodiment of the present techniques.

FIG. 6 is a partial perspective view of the enclosure 400 of FIG. 5, in which the panel 440 of the enclosure 400 is in the open position. As shown, the electromagnetic lock 700 is affixed to an inner surface 1400 of the enclosure 400. That is, an upper surface 1420 of the electromagnetic lock 700 is affixed to the inner surface 1400 of the enclosure 400. The electromagnetic lock 700 may be affixed to the enclosure 400 by welding, adhesive, fastening devices, or other suitable devices for installing the electromagnetic lock 700 within the enclosure 400. Additionally, an interior 1440 of the enclosure 400 is shown beyond the panel 440. As discussed above, the HVAC components 460 and/or the power source 740 may be disposed within the interior 1440 of the enclosure 400.

As shown, an opposed element 1500 is affixed to an inner surface 1520 of the panel 440. The opposed element 1500 may be placed on the panel 440 such that the opposed element 1500 is in contact with the electromagnetic lock 700 when the panel 440 is in the closed position. The opposed element 1500 may similarly be affixed to the panel 440 by welding, adhesive, fastening devices, or other suitable devices for installing the opposed element 1500 on the panel 440. As discussed above with reference to FIG. 5, the magnetic force produced by the engaged electromagnetic lock 700 attracts the opposed element 1500. As such, the opposed element 1500 may be made of any suitable ferromagnetic or paramagnetic material. Additionally, in some embodiments, the opposed element 1500 is a rectangular plate, a circular plate, or another suitable shape for being attracted by the magnetic force of the electromagnetic lock 700. In some embodiments, the opposed element 1500 may instead be a portion of the inner surface 1520 of the panel 440. As such, the panel 440 or the portion of the panel 440 may be formed of the ferromagnetic or paramagnetic material.

Additionally, to determine when the panel 440 is in the closed position, the enclosure 400 may include one or more contact sensors 1540. The contact sensors 1540 may be disposed on a front surface 1560 of the electromagnetic lock 700, on a side surface 1580 of the panel 440, or on another suitable surface of the enclosure 400. The contact sensors 1540 may transmit signals to the controller 220 indicative of whether the surface on which the contact sensor 1540 is disposed is in contact with or in proximity with an opposed surface. As such, the signals from the contact sensors 1540 may indicate whether the panel 440 is in the closed position or the open position. While two contact sensors 1540 are shown in FIG. 6, it is to be understood that in other embodiments, a different number of contact sensors 1540 or different types of sensors may be employed to determine if the panel 440 is in the closed position or the open position. Additionally, if multiple contact sensors 1540 are employed, the panel 440 may be determined to be partially open if one or more of the contact sensors 1540 indicate that one surface of the panel 440 is in contact with or proximity to the enclosure 400, while one or more of the contact sensors 1540 indicate that a surface of the panel 440 is not in contact with or is not proximate to the enclosure 400.

FIG. 7 is a partial perspective view of the enclosure of FIG. 5, in which the panel 440 of the enclosure 400 is in the open position. As shown, the electromagnetic lock 700 is disposed within an inner surface 1800 of the enclosure 400. That is, the electromagnetic lock 700 is embedded within a wall 1820 of the enclosure, such that a front surface 1840 of the electromagnetic lock 700 is exposed from the wall 1820. The electromagnetic lock 700 may be disposed within the wall 1820 by welding, adhesive, fastening devices, or other suitable devices for installing the electromagnetic lock 700 within the enclosure 400. Additionally, the interior 1440 of the enclosure 400 is again shown beyond the panel 440. As discussed above, the HVAC components 460 and/or the power source 740 may be disposed within the interior 1440 of the enclosure 400.

As shown, the opposed element 1500 is affixed to a longitudinal surface 1860 in a lateral side 1880 of the panel 440. The opposed element 1500 may be placed on the panel 440 such that the opposed element 1500 is in contact with or adjacent to the electromagnetic lock 700 when the panel 440 is in the closed position. The opposed element 1500 may similarly be affixed to the panel 440 by welding, adhesive, fastening devices, or other suitable devices for installing the opposed element 1500 on the panel 440. As discussed above with reference to FIG. 5, the magnetic force produced by the engaged electromagnetic lock 700 attracts the opposed element 1500. As such, the opposed element 1500 may be made of any suitable ferromagnetic or paramagnetic material. Additionally, in some embodiments, the opposed element 1500 is a rectangular plate, a circular plate, or another suitable shape for being attracted by the magnetic force of the electromagnetic lock 700. In some embodiments, the opposed element 1500 may instead be a portion of the longitudinal surface 1860 of the panel 440. As such, the panel 440 or the portion of the panel 440 may be formed of the ferromagnetic or paramagnetic material. The panel 440 and/or the enclosure 400 may additionally include the one or more contact sensors 1540 discussed above to determine when the panel 440 is in the open position, the partially open position, or the closed position.

FIG. 8 is a schematic illustrating the controller 220 of the rooftop unit 120 communicating with user devices 2000 to selectively disengage the electromagnetic lock 700. All or a portion of the components described with reference to FIG. 8 may be considered part of the control system 860 of the HVAC system 110. The user devices 2000 may communicate user input from a user to the controller 220. If the controller 220 determines that the user input is indicative of authorized user input, the controller 220 may transmit the control signals 840 to the power source 740 to interrupt the supply of the power 750 to the electromagnetic lock 700. As such, the electromagnetic lock 700 may be selectively disengaged when an authorized user requests access to the enclosure 400. In some embodiments, the controller 220 may transmit control signals 840 to the electromagnetic lock 700 if the electromagnetic lock 700 and the power source 740 are disposed within a common housing.

As shown, the user devices 2000 may wirelessly communicate to the controller 220 though a wireless connection 2020. The wireless connection 2020 may be a connection through a cellular network, radio transmission, Bluetooth® Low Energy, ZigBee®, WiFi®, or another time of wireless communication. Moreover, in some embodiments, the user devices 2000 may include a wired connection to the controller 220 to communicate the user input.

The user devices 2000 may include a variety of devices. For example, the user interface 1000 of the enclosure 400 discussed above may be a user device 2000 used to provide the user input to the controller 220. The user interface 1000 may include a number pad the user employs to input an access code, or another suitable device for receiving the user input. Because the user interface 1000 is connected to the enclosure 400, the user interface 1000 may include a wired communication to the controller 220.

The user devices 2000 may also include an identification card 2040. The identification card 2040 may include one or more antenna coils and/or RFID elements to transmit an identification code to a corresponding card reader of the enclosure 400. For example, in embodiments in which the user interface 1000 includes a card reader, the user may provide the identification card 2040 to the user interface 1000, which collects the identification code. The user interface 1000 may then transmit a signal indicative of the identification code to the controller 220 to determine whether the user is authorized to access the interior of the enclosure 400.

The user devices 2000 may also include a computer 2060. The computer 2060 may be a laptop or desktop to transmit the user input to the controller 220. For example, the user may employ the computer 2060 to wireless transmit credentials to access the HVAC components 460 within the enclosure 400. With the computer 2060, the user may also schedule a visit to the enclosure 400 at a later date. Then, if the user input is indicative of authorized user input, the controller 220 may adjust the locking schedule of the electromagnetic lock 700 to disengage the electromagnetic lock 700 during the scheduled visit.

The user devices may additionally include a mobile device 2080. The mobile device 2080 may be a cell phone, a tablet, smart glasses, or another mobile device the user employs to provide the user input to the controller 220. The user input may be provided wirelessly to the user interface 1000 and/or to the controller 220. The user interface 1000 or the controller 220 then verifies the user input corresponds to authorized user input before disengaging the electromagnetic lock 700.

Moreover, the controller 220 may receive wireless communications from the wireless connection between the contact sensors 1540 and the controller 220. As such, the contact sensors 1540 may alert the controller to when the panel 440 is in the open position, the partially open position, or the closed position.

Accordingly, the present disclosure is directed to electromagnetic locks 700 to control access to an enclosure 400 of the HVAC system 110. The enclosure 400 protects the HVAC components 460 from contaminants and debris on the building and/or unauthorized users. The panel 440 of the enclosure 400 is locked by the electromagnetic lock 700, which generates a magnetic field that retains the panel in a closed position by attracting an opposed element of the panel. The magnetic field may be selectively generated when power from a power source is supplied to coils of the electromagnetic lock. The electromagnetic lock 700 may provide a greater resistance to wear, degradation, tampering, and/or malfunctioning than traditional keyed locks. Thus, by including the electromagnetic lock 700 on the enclosure 400, the panel 440 of the enclosure 400 may only be opened to provide authorized users access to the HVAC components 460, while providing valuable information related to the access of the enclosure.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. The order or sequence of any process or method steps may be varied or resequenced according to alternative embodiments. It is, therefore, to be understood that the appended claims are intended to cover all such modifications and changes as fall within the true spirit of the disclosure. Furthermore, in an effort to provide a concise description of the embodiments, all features of an actual implementation may not have been described (i.e., those unrelated to the presently contemplated best mode of carrying out the disclosure, or those unrelated to enabling the claimed features). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilating, and air conditioning (HVAC) system, comprising:

an HVAC unit, wherein the HVAC unit comprises:

an enclosure comprising a panel disposed in a corresponding opening of the enclosure;

a refrigeration circuit disposed within an interior of the enclosure, wherein the refrigeration circuit includes an evaporator and a condenser fluidly coupled by refrigerant conduits; and an electromagnetic lock fixed to a surface of the interior of the enclosure, wherein the electromagnetic lock is configured to retain the panel in a closed position relative to the enclosure to contain the refrigeration circuit therein, and wherein the electromagnetic lock is configured to enable user access to the interior of the enclosure from an exterior of the enclosure.

2. The HVAC system of claim 1, wherein the HVAC unit comprises a power source disposed within the interior of the enclosure, and wherein the electromagnetic lock is powered by the power source.

3. The HVAC system of claim 2, comprising a controller configured to transmit a first signal to the power source to engage the electromagnetic lock and configured to transmit a second signal to the power source to disengage the electromagnetic lock, wherein the electromagnetic lock retains the panel in the closed position when the electromagnetic lock is engaged, wherein the electromagnetic lock does not retain the panel in the in the closed position when the electromagnetic lock is disengaged.

4. The HVAC system of claim 3, wherein the controller automatically transmits the first signal, the second signal, or a combination thereof based on a locking schedule, operating hours of a building associated with the HVAC system, or a combination thereof.

5. The HVAC system of claim 3, comprising a user interface configured to receive user input, wherein the user interface transmits a third signal indicative of the user input to the controller, wherein the controller determines if the user input is indicative of an authorized user input, and wherein the controller transmits the second signal to the power source when the user input is indicative of the authorized user input.

6. The HVAC system of claim 3, wherein the controller is configured to:

wirelessly receive user input from a user device;

determine if the user input is indicative of an authorized user input; and transmit the second signal to the power source when the user input is indicative of the authorized user input, wherein the user device comprises a cell phone, a tablet, smart glasses, a laptop, a desktop, or a combination thereof.

7. The HVAC system of claim 3, wherein the enclosure comprises a contact sensor, wherein the contact sensor is configured to transmit a third signal to the controller indicative of when the panel is in the closed position relative to the enclosure and a fourth signal to the controller indicative of when the panel is in an open position relative to the enclosure.

8. The HVAC system of claim 4, wherein the user interface is configured to receive the user input from an identification card, a cell phone, a tablet, smart glasses, a laptop, a desktop, a number pad, or a combination thereof.

9. The HVAC system of claim 1, wherein the electromagnetic lock is fail-secure.

10. The HVAC system of claim 1, comprising a controller configured to cause engagement of the electromagnetic lock in response to determining that, based on a sensor signal from a contact sensor, the panel has been in the closed position for a time threshold after transitioning to the closed position from an open position.

11. The HVAC system of claim 1, wherein the panel of the enclosure comprises an opposed element, wherein the opposed element is disposed opposite the electromagnetic lock when the panel is in the closed position, and wherein the electromagnetic lock produces a magnetic field that attracts the opposed element to retain the panel in the closed position.

12. The HVAC system of claim 11, wherein the opposed element is a portion of the panel, a plate fixed to the panel, or a combination thereof, and wherein the opposed element comprises ferromagnetic material.

13. A heating, ventilating, and air conditioning (HVAC) system, comprising:

a rooftop unit having an enclosure including a panel;

a circuit having an evaporator, a compressor, a condenser, and an expansion device disposed within the enclosure;

an electromagnetic lock fixed to a surface of the rooftop unit, wherein the electromagnetic lock is configured to selectively retain the panel in a closed position;

a contact sensor configured to detect the panel in the closed position;

a power source coupled to the electromagnetic lock and configured to provide power to the electromagnet lock; and a controller coupled to the contact sensor and configured to selectively engage and disengage the electromagnetic lock, wherein the controller is configured to:

receive a sensor signal from the contact sensor indicative of the panel being in the closed position;

transmit a first signal to the power source to engage the electromagnetic lock in response to determining that, after transitioning to the closed position from an open position, the panel has been in the closed position for a time threshold, wherein the electromagnetic lock retains the panel in the closed position when the electromagnetic lock is engaged; and transmit a second signal to the power source to disengage the electromagnetic lock, wherein the electromagnetic lock does not retain the panel in the in the closed position when the electromagnetic lock is disengaged.

14. The HVAC system of claim 13, wherein the controller is configured to:

receive a third signal indicative of user input from a user device, wherein the user device comprises a user interface, a cell phone, a tablet, smart glasses, a laptop, a desktop, or a combination thereof;

determine if the user input is indicative of an authorized user input by comparing the user input to a database of authorized user inputs stored in a memory device of the controller; and transmit the second signal to the power source if the user input is indicative of the authorized user input.

15. The HVAC system of claim 14, wherein the controller is configured to receive a fourth signal indicative of user access data and store a log of the user access data, wherein the user access data comprises: time stamps of when the electromagnetic lock is disengaged, durations of when the electromagnetic lock is disengaged, time stamps of when the panel is in the open position relative to the rooftop unit, durations of time when the panel is in the open position relative to the rooftop unit, a log of user inputs provided to the user interface, a log of user inputs provided to the controller, a log of user inputs verified as authorized, a log of user inputs determined to be unauthorized, or a combination thereof.

16. The HVAC system of claim 15, wherein the contact sensor is configured to transmit the fourth signal indicative of the time stamps of when the panel is in the open position, the durations of time when the panel is in the open position, or a combination thereof.

17. The HVAC system of claim 13, wherein the controller is configured to:

receive a locking schedule for the electromagnetic lock, wherein the locking schedule specifies first scheduled times to transmit the first signal to the power source, second scheduled times to transmit the second signal to the power source, or a combination thereof; and transmit the first signal to the power source at the first scheduled times, transmit the second signal to the power source at the second scheduled times, or a combination thereof.

18. The HVAC system of claim 17, wherein the controller is configured to:

receive a third signal indicative of a request to schedule a desired scheduled time for the controller to transmit the second signal to the power source;

receive a fourth signal indicative of user input from a user device;

determine if the user input is indicative of an authorized user input by comparing the user input to a database of authorized user inputs stored in a memory device of the controller; and update the locking schedule for the electromagnetic lock such that the second signal is transmitted to the power source at the desired scheduled time if the user input is indicative of the authorized user input.

19. A heating, ventilating, and air conditioning (HVAC) system, comprising:

an HVAC unit, wherein the HVAC unit comprises:

an enclosure comprising a panel;

a heat exchanger disposed within an interior of enclosure, wherein the heat exchanger is accessible when the panel is in an open position relative to the enclosure, and wherein the heat exchanger is not accessible when the panel is in a closed position relative to the enclosure;

an electromagnetic lock disposed in the enclosure;

an opposed element of the panel, wherein the opposed element is adjacent to the electromagnetic lock when the panel is in the closed position, and wherein, when engaged, the electromagnetic lock is configured to selectively produce a magnetic field that attracts the opposed element to retain the panel in the closed position; and a controller configured to:

wirelessly receive user input from a portable electronic device;

selectively engage and disengage the electromagnetic lock based on the user input; and store user access data based on the user input, wherein the user access data includes a first time stamp and a first duration that the electromagnetic lock is disengaged and a second time stamp and a second duration that the panel is in the open position.

20. The HVAC system of claim 19, wherein the opposed element is a portion of the panel, wherein the portion of the panel comprises a ferromagnetic material.

21. The HVAC system of claim 19, wherein the electromagnetic lock includes an electromagnet that is disposed within a surface of a wall of the enclosure, wherein the opposed element is a plate disposed within a lateral side of the panel, such that a surface of the electromagnetic lock is adjacent the opposed element when the panel is in the closed position.

22. The HVAC system of claim 19, wherein the heat exchanger is configured to condition an air flow supplied to a building of the HVAC system.

23. The HVAC system of claim 19, comprising a power source configured to selectively supply power to the electromagnetic lock based on instructions from the controller, wherein the electromagnetic lock produces the magnetic field when the power is supplied to electromagnetic lock, and wherein the electromagnetic lock does not produce the magnetic field when the power is not supplied to the electromagnetic lock.

24. The HVAC system of claim 19, comprising an additional electromagnetic lock disposed in the enclosure, and an additional opposed element of the panel, wherein the additional opposed element is adjacent to the additional electromagnetic lock when the panel is in the closed position, and wherein the additional electromagnetic lock is configured to produce an additional magnetic field that attracts the additional opposed element to retain the panel in the closed position.

25. The HVAC system of claim 19, comprising a filter, a blower, or a combination thereof disposed within the enclosure.

* * * * *